US011404829B2

(12) United States Patent
Kumar et al.

(10) Patent No.: US 11,404,829 B2
(45) Date of Patent: Aug. 2, 2022

(54) PLUGGABLE ELECTRONIC RECEPTACLE CONNECTOR WITH HEAT-SINK ASSEMBLY

(71) Applicant: Molex, LLC, Lisle, IL (US)

(72) Inventors: Tejesh K C Kumar, Bangalore (IN); Chun-Hsiang Chiang, New Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/020,818

(22) Filed: Sep. 15, 2020

(65) Prior Publication Data

US 2021/0083435 A1 Mar. 18, 2021

(30) Foreign Application Priority Data

Sep. 17, 2019 (CN) ..... 201910875992.5

(51) Int. Cl.
*H01R 13/6591* (2011.01)
*H01R 13/502* (2006.01)

(52) U.S. Cl.
CPC ..... *H01R 13/6591* (2013.01); *H01R 13/502* (2013.01)

(58) Field of Classification Search
CPC ..... H01R 13/6591; H01R 13/502
USPC ..... 439/607.01
See application file for complete search history.

(56) References Cited

U.S. PATENT DOCUMENTS 6,205,026 B1 * 3/2001 Wong ..... H01L 23/4093 165/80.3
6,752,663 B2 * 6/2004 Bright ..... G02B 6/4201 439/607.25
6,816,376 B2 * 11/2004 Bright ..... G02B 6/4201 361/704
6,893,293 B2 * 5/2005 Ice ..... G02B 6/4277 439/607.2
6,980,437 B2 * 12/2005 Bright ..... H04B 1/036 165/185
7,317,617 B2 * 1/2008 Meadowcroft ..... G02B 6/4201 165/104.33

(Continued)

FOREIGN PATENT DOCUMENTS

CN 200994252 Y 12/2007
JP 2002-261212 A 9/2002
TW M468059 U 12/2013

*Primary Examiner* — Peter G Leigh

(57) ABSTRACT

A connector assembly comprising a shielding shell, a heat dissipating module and a clip. The shielding shell comprises a top wall and two side walls. The heat dissipating module comprises a thermal conducting plate which is provided to a top wall of the shielding shell. Side edges of the thermal conducting plate comprise rearward stopped portions toward the rear. The clip comprises an elastic pressing portion which presses against a top surface of the thermal conducting plate and outer side plates which are assembled to the corresponding side walls of the shielding shell. The outer side plate comprises a rearward displace limiting portion. The rearward displace limiting portion cooperates with the corresponding rearward stopped portion of the thermal conducting plate so as to limit relative displacement of the thermal conducting plate relative to the shielding shell toward the rear. Therefore, it may prevent the thermal conducting plate from disengaging.

19 Claims, 12 Drawing Sheets

(56) References Cited

U.S. PATENT DOCUMENTS

| | | | | |
|---|---|---|---|---|
| 7,355,857 | B2 * | 4/2008 | Pirillis | H05K 9/0058 361/715 |
| 7,794,241 | B2 * | 9/2010 | Bright | H01R 12/721 439/79 |
| 8,444,437 | B2 * | 5/2013 | Szczesny | H01R 13/6587 439/607.17 |
| 8,449,331 | B2 * | 5/2013 | Phillips | H01R 13/6581 439/607.21 |
| 8,556,658 | B2 * | 10/2013 | Szczesny | G02B 6/4278 439/607.2 |
| 8,599,559 | B1 * | 12/2013 | Morrison | H05K 9/0058 361/702 |
| 8,670,236 | B2 * | 3/2014 | Szczesny | H05K 9/0009 361/704 |
| 8,830,679 | B2 * | 9/2014 | Scholeno | H01R 13/6595 361/711 |
| 9,402,332 | B2 * | 7/2016 | McKervey | H05K 7/20409 |
| 10,069,248 | B2 * | 9/2018 | Su | H01R 13/6583 |
| 2002/0118513 | A1 * | 8/2002 | Koseki | H01L 23/4093 361/709 |
| 2006/0291171 | A1 * | 12/2006 | Ahrens | G02B 6/4292 361/716 |
| 2007/0183128 | A1 * | 8/2007 | Pirillis | H05K 7/20418 361/715 |
| 2011/0044006 | A1 * | 2/2011 | Kim | H01R 13/6594 361/715 |
| 2019/0132938 | A1 * | 5/2019 | Mira | H01L 23/427 |
| 2019/0200479 | A1 * | 6/2019 | Yatskov | F28F 13/00 |
| 2019/0215989 | A1 * | 7/2019 | Su | H01R 13/646 |

* cited by examiner

50

60

60

PLUGGABLE ELECTRONIC RECEPTACLE CONNECTOR WITH HEAT-SINK ASSEMBLY

RELATED APPLICATION

This application claims priority to Chinese Application No. 201910875992.5, filed on Sep. 17, 2019, which is incorporated by reference in its entirety.

TECHNICAL FIELD

The present disclosure relates to a connector assembly, and more particularly, the present disclosure relates to a connector assembly having a clip.

BACKGROUND

Japanese patent application publication No. JP2002-261212A discloses a clip. The clip has a front mounting leg section and a rear mounting leg section and a front stopping leg and a rear stopping leg which respectively contact a front edge and a rear edge of a base plate of a heat sink. In an embodiment of the patent document, the front stopping leg and the rear stopping leg each include a connecting part. The connecting part of the front stopping leg is connected to a lower surface of a middle part of a front connecting section in a length direction. The connecting part of the rear stopping leg is connected to a lower surface of a middle part of a rear connecting section in the length direction.

In another embodiment of the patent document, a heat sink fixing clip is integrally formed from a metal sheet. A structure of a front stopping leg of the heat sink fixing clip is to form a general U-shape cut opening in a middle part of a front connecting section in a length direction and then bend downwardly into a groove of the base plate. A structure of a rear stopping leg of the heat sink fixing clip is similar to that of the front stopping leg. Therefore, displacement of the heat sink in a front-rear direction is limited In a case that an upper surface of a heat sink is configured as a plane, for example, the upper surface of the heat sink does not have a groove for receiving a clip as the above patent document, a clip or a heat sink fixing clip cannot limit displacement of the heat sink in the front-rear direction. For example, when a plug is inserted into or pulled out in the front-rear direction, the heat sink is relatively easy to displace and disengage.

The description of the above "background" only provides a background, and it is not admitted that the description of the above "background" discloses the protection scope of the present disclosure, and the description of the above "background" does not constitute the background of the present disclosure, and any description of the above "background" should not be considered as any part of the present disclosure.

SUMMARY

An embodiment of the present disclosure provides a connector assembly comprising a shielding shell, a heat dissipating module and a clip. The shielding shell comprises a top wall, two side walls and a receiving space which extends along a front-rear direction, the receiving space comprises a front end toward the front. The front end comprises an insertion opening. The heat dissipating module comprises a thermal conducting plate which corresponds to the receiving space and is provided to the top wall of the shielding shell. Side edges of the thermal conducting plate comprise rearward stopped portions toward the rear. The clip comprises an elastic pressing portion which presses against a top surface of the thermal conducting plate and outer side plates which are assembled to the corresponding side walls of the shielding shell. The outer side plate comprises a rearward displace limiting portion which cooperates with the corresponding rearward stopped portion of the thermal conducting plate so as to limit relative displacement of the thermal conducting plate relative to the shielding shell toward the rear.

In some embodiments, the side edge of the thermal conducting plate comprises a notch, the notch comprises a front end. The front end comprises the rearward stopped portion. The rearward stopped portion comprises an inner edge of the front end of the notch toward the rear. The rearward displace limiting portion of the clip comprises a front sheet. The front sheet extends to the rear of the corresponding rearward stopped portion of the thermal conducting plate.

In some embodiments, the side edge of the thermal conducting plate further comprises a forward stopped portion toward the front. The outer side plate of the clip further comprises a forward displace limiting portion. The forward displace limiting portion cooperates with the corresponding forward stopped portion of the thermal conducting plate so as to limit relative displacement of the thermal conducting plate relative to the shielding shell toward the front.

In some embodiments, the side edge of the thermal conducting plate comprises a notch. The notch comprises a front end and a rear end. The front end comprises the rearward stopped portion. The rearward stopped portion comprises an inner edge of the front end of the notch toward the rear. The rear end comprises the forward stopped portion. The forward stopped portion comprises an inner edge of the rear end of the notch toward the front. The rearward displace limiting portion of the clip comprises a front sheet. The front sheet extends to the rear of the corresponding rearward stopped portion of the thermal conducting plate. The forward displace limiting portion of the clip comprises a rear sheet. The rear sheet extends to the front of the corresponding forward stopped portion of the thermal conducting plate.

In some embodiments, the front sheet is a sheet whose sheet face is in vertical or a sheet whose sheet face horizontally lies.

In some embodiments, the front sheet and the rear sheet each are a sheet whose sheet face is in vertical or a sheet whose sheet face horizontally lies.

In some embodiments, the top wall of the shielding shell comprises a window which passes through and communicates with the receiving space, wherein the heat dissipating module further comprises a contacting plate which is provided to a bottom surface of the thermal conducting plate, the contacting plate extends into the receiving space via the window.

In some embodiment, the thermal conducting plate is a vapor chamber heatsink.

Another embodiment of the present disclosure provides a connector assembly. The connector assembly comprises a shielding shell, at least two heat dissipating modules and a clip. The shielding shell comprises a top wall, two side walls and at least two receiving spaces which extend along a front-rear direction. Each receiving space comprises a front end toward the front. The front end comprises an insertion opening. The at least two heat dissipating modules respectively correspond to the at least two receiving spaces. Each heat dissipating module comprises a thermal conducting plate which is provided to the top wall of the shielding shell.

The thermal conducting plate comprises two side edges. The two side edges of the thermal conducting plate each comprise a rearward stopped portion toward the rear. The clip comprises an inner fixing portion fixed to the top wall of the shielding shell, outer side plates which are assembled to the corresponding side walls of the shielding shell, elastic pressing portions which press against top surfaces of the corresponding thermal conducting plates, and inner side plates which each are provided between the elastic pressing portion and the inner fixing portion. The outer side plate of the clip comprises a first rearward displace limiting portion, and the inner side plate of the clip comprises a second rearward displace limiting portion. The first rearward displace limiting portion of the outer side plate of the clip and the rearward stopped portion of the corresponding side edge of the corresponding thermal conducting plate cooperate with each other and the second rearward displace limiting portion of the inner side plate of the clip and the rearward stopped portion of the corresponding side edge of the corresponding thermal conducting plate cooperate with each other, so as to limit relative displacement of the corresponding thermal conducting plate relative to the shielding shell toward the rear.

In some embodiments, the two side edges of the thermal conducting plate each comprise a notch. The notch comprises a front end. The front end comprises the rearward stopped portion. The rearward stopped portion comprises an inner edge of the front end of the notch toward the rear. The first rearward displace limiting portion of the outer side plate of the clip comprises a front sheet. The front sheet extends to the rear of the rearward stopped portion of the corresponding side edge of the corresponding thermal conducting plate. The second rearward displace limiting portion of the inner side plate of the clip comprises a front edge. The front edge extends to the rear of the rearward stopped portion of the corresponding side edge of the corresponding thermal conducting plate.

In some embodiments, the two side edges of the thermal conducting plate each further comprise a forward stopped portion toward the front. The outer side plate of the clip comprises a first forward displace limiting portion, and the inner side plate of the clip comprises a second forward displace limiting portion. The first forward displace limiting portion of the outer side plate of the clip and the forward stopped portion of the corresponding side edge of the corresponding thermal conducting plate cooperate with each other and the second forward displace limiting portion of the inner side plate of the clip and the forward stopped portion of the corresponding side edge of the corresponding thermal conducting plate cooperate with each other, so as to limit relative displacement of the corresponding thermal conducting plate relative to the shielding shell toward the front.

In some embodiments, the two side edges of the thermal conducting plate each comprise a notch. The notch comprises a front end and a rear end. The front end comprises the rearward stopped portion. The rearward stopped portion comprises an inner edge of the front end of the notch toward the rear. The first rearward displace limiting portion of the outer side plate of the clip comprises a front sheet. The front sheet extends to the rear of the rearward stopped portion of the corresponding side edge of the corresponding thermal conducting plate. The first forward displace limiting portion of the outer side plate of the clip comprises a rear sheet. The rear sheet extends to the front of the forward stopped portion of the corresponding side edge of the corresponding thermal conducting plate. The second rearward displace limiting portion of the inner side plate of the clip comprises a front edge. The front edge extends to the rear of the rearward stopped portion of the corresponding side edge of the corresponding thermal conducting plate. The second forward displace limiting portion of the inner side plate of the clip comprises a rear edge. The rear edge extends to the front of the forward stopped portion of the corresponding side edge of the corresponding thermal conducting plate.

In some embodiments, the front sheet is a sheet whose sheet face is in vertical or a sheet whose sheet face horizontally lies.

In some embodiments, the front sheet and the rear sheet each are a sheet whose sheet face is in vertical or a sheet whose sheet face horizontally lies.

In some embodiments, the top wall of the shielding shell comprises windows which each pass through and communicate with the corresponding receiving space, wherein each heat dissipating module further comprises a contacting plate which is provided to a bottom surface of the thermal conducting plate, each contacting plate extends into the corresponding receiving space via the corresponding window.

In some embodiments, the thermal conducting plate is a vapor chamber heatsink.

Another embodiment of the present disclosure provides a connector assembly. The connector assembly comprises a shielding shell, at least one heat dissipating module and a clip. The shielding shell comprises a top wall, side walls and at least one receiving space which extends along a front-rear direction. The receiving space comprises a front end toward the front. The front end comprises an insertion opening. The at least one heat dissipating module comprises a thermal conducting plate which corresponds to the receiving space and is provided to the top wall. Side edges of the thermal conducting plate comprising stopped portions. The clip comprises an elastic pressing portion which presses against a top surface of the thermal conducting plate and side plates. The side plate of the clip comprising a limiting portion, the limiting portion is configured to cooperate with the corresponding stopped portion of the thermal conducting plate so as to limit relative displacement of the thermal conducting plate relative to the shielding shell toward the front or toward the rear.

In the present disclosure, the clip, the thermal conducting plate and the shielding shell cooperate with each other to limit relative displacement of the thermal conducting plate relative to the shielding shell in the left-right direction, the up-down direction and the front-rear direction. Therefore, it can avoid the thermal conducting plate from unintentionally disengaging from the shielding shell.

The technical features and advantages of the present disclosure have been generalized quite broadly above, so that the detailed description of the present application below can be better understood. Other technical features and advantages constituting the protection scope of the claims of the present disclosure will be described below. Those skilled persons in the art should understand that the concepts and specific embodiments disclosed below can be easily utilized to modify or design other structures or manufacturing methods to achieve the same purpose as the present disclosure. Those skilled persons in the art should also understand that such equivalent construction cannot depart from the spirit and scope defined by the appended claims of the present disclosure.

BRIEF DESCRIPTION OF THE DRAWINGS

The disclosed contents of the present disclosure can be more fully understood in conjunction with the detailed description and claims referring to the drawings, and the same reference numeral indicates the same element in the drawings.

DETAILED DESCRIPTION OF THE PREFERRED EMBODIMENTS

Figure 1:
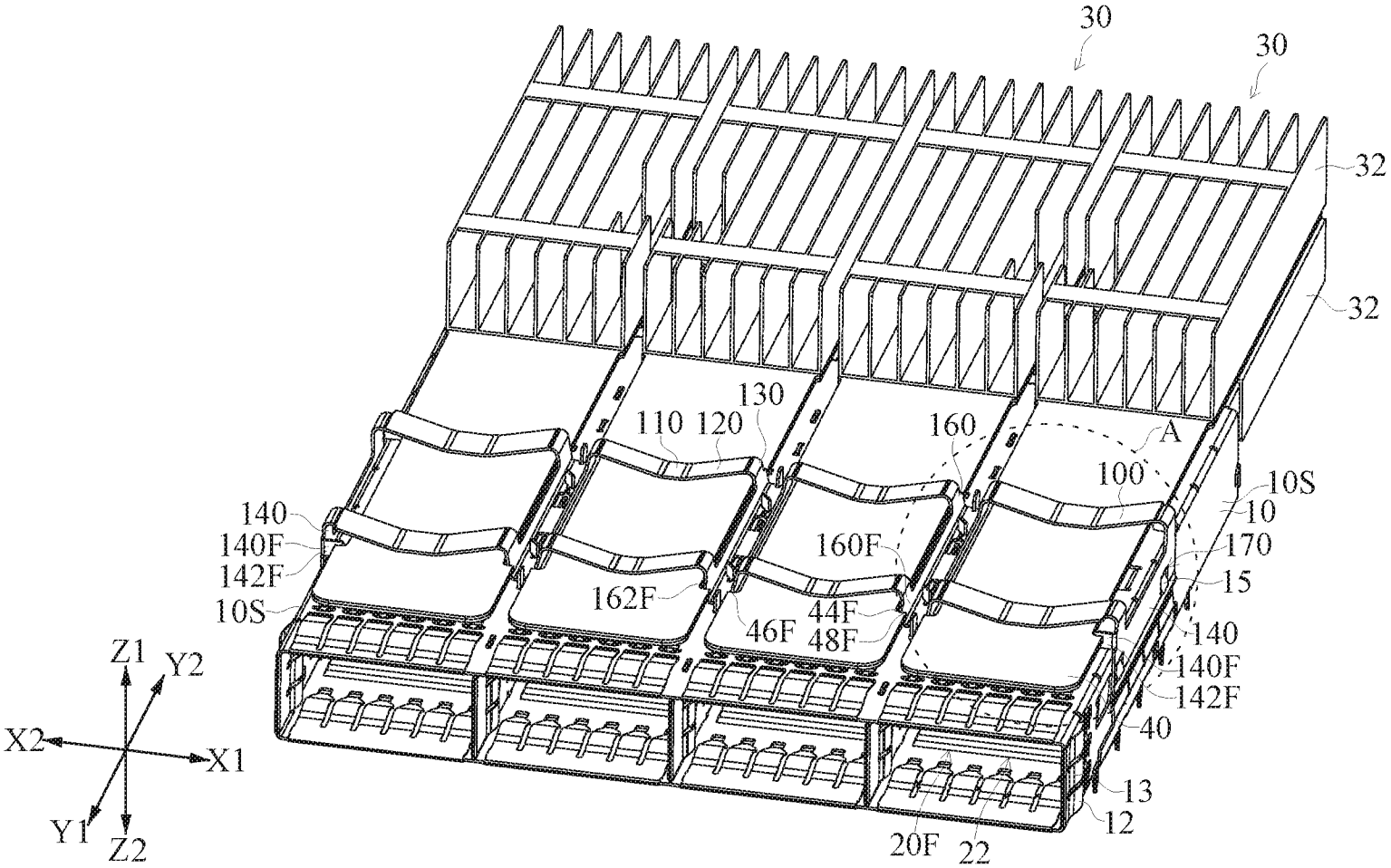
FIG. 1 is an assembled perspective schematic view of a first embodiment of a connector assembly.

The embodiments or examples of the disclosed contents illustrated in the drawings are described with specific language. It should be understood that it is not intended to limit the scope of the present disclosure. Reference numerals may be repeated in each embodiment, but even if they have the same reference numerals, the features in an embodiment are not necessarily used in another embodiment.

It will be understood that the various elements, assemblies, regions, layers or sections may be described herein using the terms first, second, third, etc., however, these elements, assemblies, regions, layers or sections are not limited to these terms. These terms are only used to distinguish one element, assembly, region, layer or section from another element, assembly, region, layer or section. The first element, assembly, region, layer or section described below may be referred to as a second element, assembly, region, layer or section without departing from the teachings of the inventive concept of the present disclosure.

The words used in the present disclosure are only used for the purpose of describing the specific exemplary embodiments and are not intended to limit the scope of the present disclosure. As used herein, "a" and "the" in singular form are also used to include plural, unless otherwise expressly indicated herein. It is to be understood that the word "include" used in the specification specifically indicates the existence of a feature, integer, step, operation, element or assembly which is described, but does not exclude the existence of one or more other features, integers, steps, operations, elements, assemblies or groups thereof.

Figure 2:
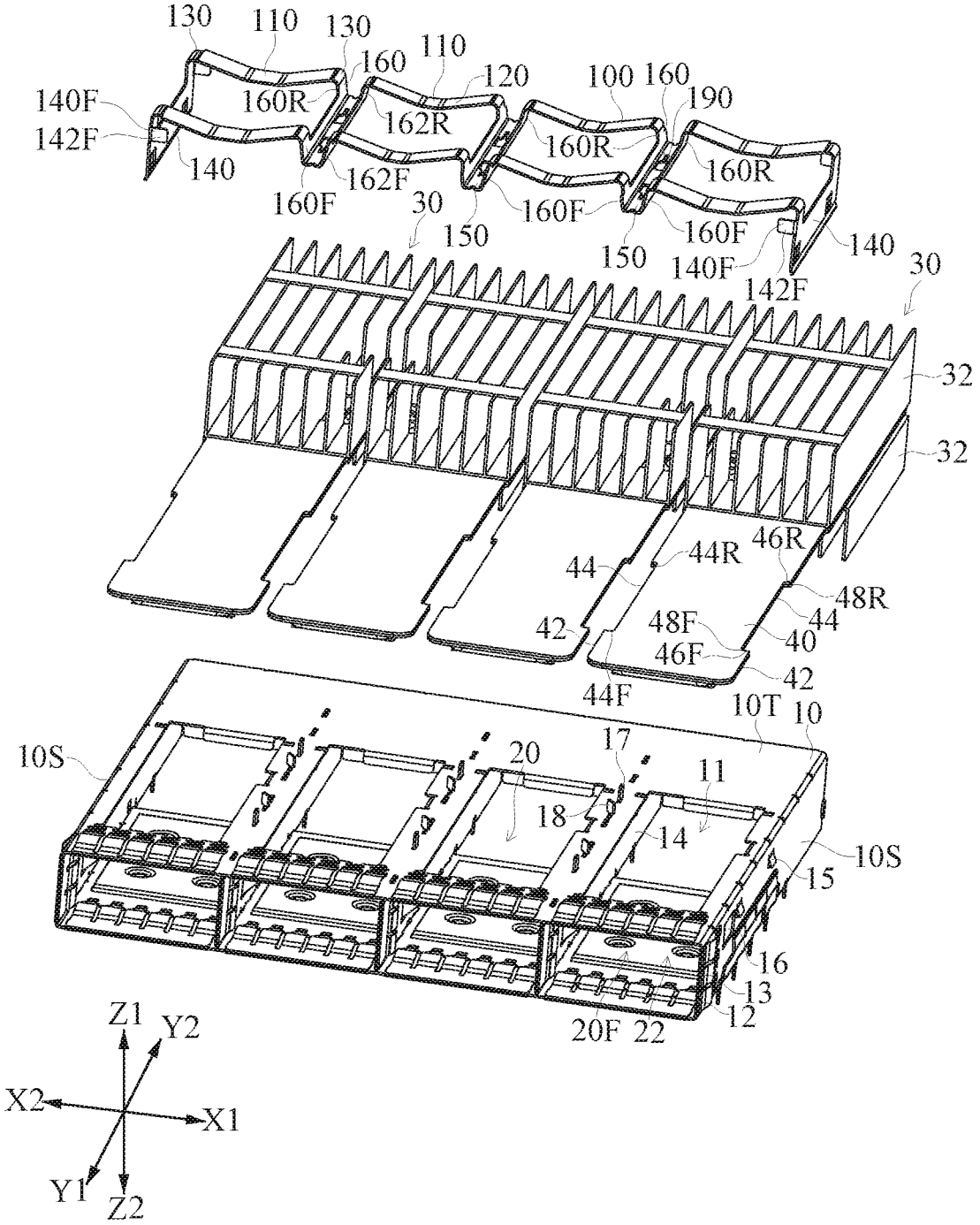
FIG. 2 is an exploded perspective schematic view of the connector assembly of FIG. 1.
Figure 3:
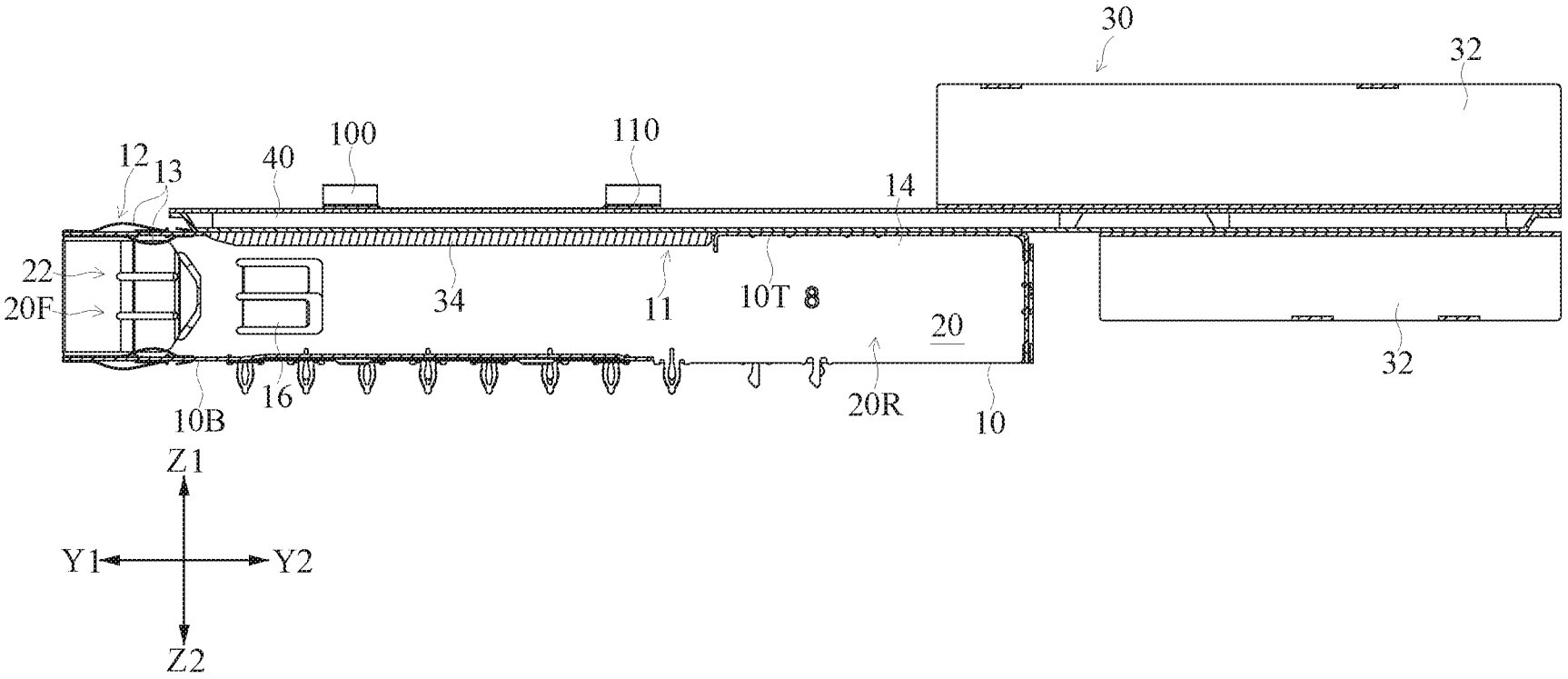
FIG. 3 is a cross sectional schematic view of connector assembly of FIG. 1.

FIG. 1 is an assembled perspective schematic view of a first embodiment of a connector assembly 5. FIG. 2 is an exploded perspective schematic view of the connector assembly 5 of FIG. 1. FIG. 3 is a cross sectional schematic view of the connector assembly 5 of FIG. 1 along a front-rear direction Y1-Y2, in which the front-rear direction Y1-Y2 corresponds to a mating direction of a plug connector (not shown). Referring to FIG. 1 to FIG. 3, a connector assembly 5 includes a shielding shell 10 provided on a board (not shown), a plurality of heat dissipating modules 30 mounted to the shielding shell 10 and a clip 100 mounting the plurality of heat dissipating modules 30 to the shielding shell 10. In some embodiments, the board is a printed circuit board. The embodiment includes four heat dissipating module 30.

The shielding shell 10 includes a top wall 10T and a bottom wall 10B which face each other and spaced apart from each other in an up-down direction Z1-Z2 (referring to FIG. 3). The top wall 10T and the bottom wall 10B each extend in a left-right direction X2-X1 and the front-rear direction Y1-Y2. The shielding shell 10 further includes two side walls 10S which extend between the top wall 10T and the bottom wall 10B along the up-down direction Z1-Z2 and are provided to edges of the top wall 10T and the bottom wall 10B respectively. In addition, the shielding shell 10 includes a plurality of receiving spaces 20 which are defined by the top wall 10T, the bottom wall 10B and the two side walls 10S and extend along the front-rear direction Y1-Y2, in which two adjacent receiving space 20 are partitioned by one partitioning plate 14 of the shielding shell 10. The embodiment includes four receiving spaces 20, but the present disclosure is not limited thereto. In some embodiments, the shielding shell 10 may include four or more receiving spaces 20. In some embodiments, the shielding shell 10 may include four or less receiving space(s) 20.

The top wall 10T of the shielding shell 10 includes a window 11 which passes through and communicates with the corresponding receiving space 20. The embodiment correspondingly includes four windows 11. Each receiving space 20 includes a front end 20F toward a front Y1 and a rear end 20R which is opposite to the front end 20F and covers a receptacle connector (not shown) provided on the board, as shown in FIG. 3. The front end 20F of each receiving space 20 includes an insertion opening 22. The insertion opening 22 allows a plug connector to insert into, so that the plug connector mates with the receptacle connector provided on the board. In addition, the plug connector is locked by an inner elastic tab 16 of the shielding shell 10. Moreover, a grounding member 12 is provided around the insertion opening 22 of the shielding shell 10, and the grounding member 12 includes a plurality of elastic grounding fingers 13.

Figure 4:
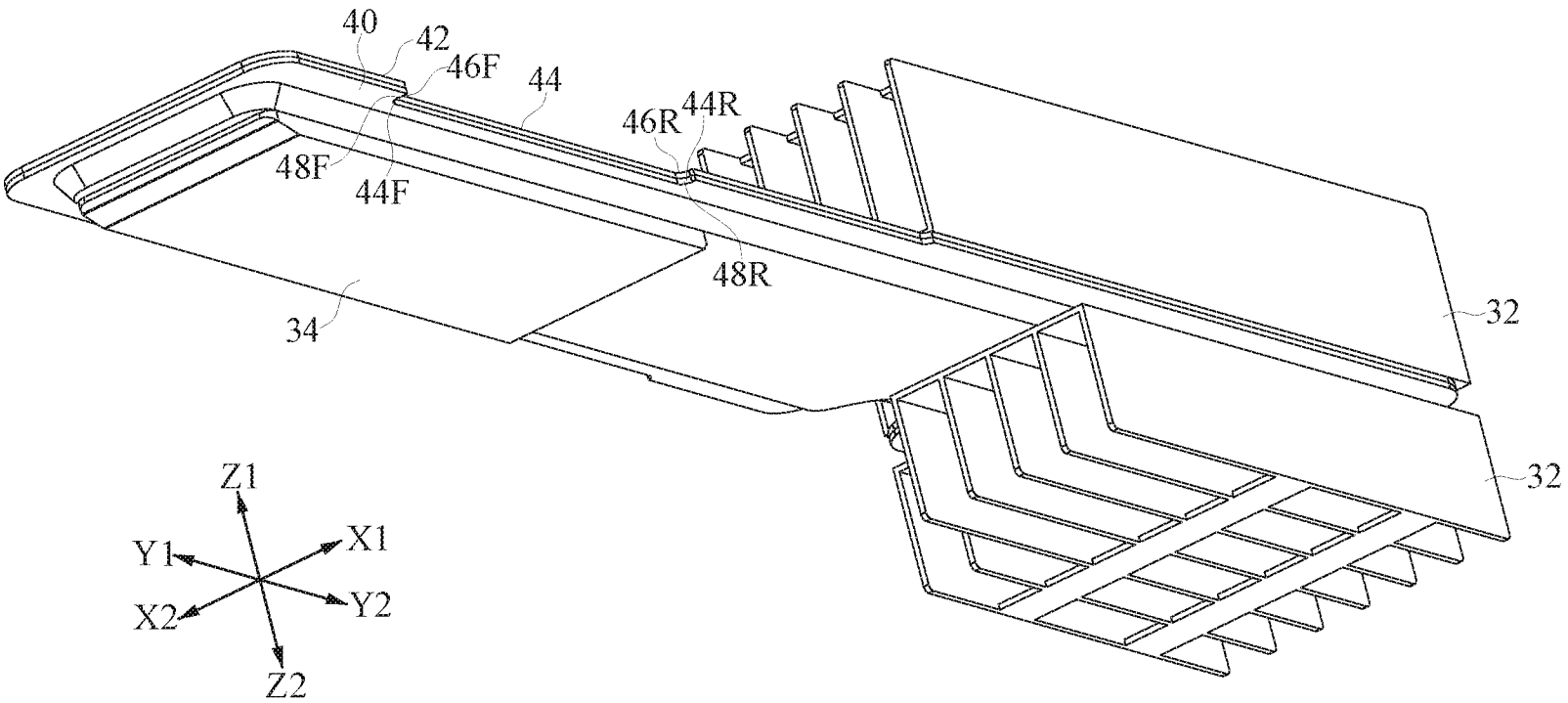
FIG. 4 is a perspective schematic view of one of heat dissipating modules shown in FIG. 1.

FIG. 4 is a perspective schematic view of one of the heat dissipating modules 30 shown in FIG. 1. Referring to FIG. 2 and FIG. 4, each heat dissipating module 30 includes a thermal conducting plate 40 which corresponds to the receiving space 20 and is provided to the top wall 10T of the shielding shell 10, a plurality of heat dissipating fins 32 and a contacting plate 34 which is provided to a bottom surface of the thermal conducting plate 40 and extends into the corresponding receiving space 20 via the corresponding window 11 of the top wall 10T (as shown in FIG. 3). When the plug connector inserts into the shielding shell 10, the plug connector contacts and pushes up the contacting plate 34. Therefore, heat of the plug connector is transferred to the heat dissipating fin 32 via the contacting plate 34 and the thermal conducting plate 40, thus is dissipated by the heat dissipating fin 32. In some embodiments, the contacting plate 34 the thermal conducting plate 40 may be integrally formed. In some embodiments, the contacting plate 34 and the thermal conducting plate 40 may be separately formed and then assembled together.

Referring to FIG. 1 and FIG. 4, each heat dissipating fin 32 is spaced apart from the clip 100 in the front-rear direction Y1-Y2. Specifically, the clip 100 cooperates with a front segment of each thermal conducting plate 40, and each heat dissipating fin 32 is provided to a rear segment of each thermal conducting plate 40. In some embodiments, each heat dissipating fin 32 may be provided to the thermal conducting plate 40 by welding. In some embodiments, the thermal conducting plate 40 is a vapor chamber heatsink.

Referring to FIG. 2 and FIG. 4, each thermal conducting plate 40 includes two side edges 42. Each side edge 42 includes a rearward stopped portion 46F toward a rear Y2 and a forward stopped portion 46R toward the front Y1. Specifically, each side edge 42 of the thermal conducting plate 40 includes a notch 44. The notch 44 includes a front end 44F and a rear end 44R. The front end 44F of the notch 44 includes the rearward stopped portion 46F, and the rearward stopped portion 46F includes an inner edge 48F of the front end 44F of the notch 44 toward the rear Y2. Correspondingly, the rear end 44R of the notch 44 includes the forward stopped portion 46R, and the forward stopped portion 46R includes an inner edge 48R of the rear end 44R of the notch 44 toward the front Y1.

Figure 5:
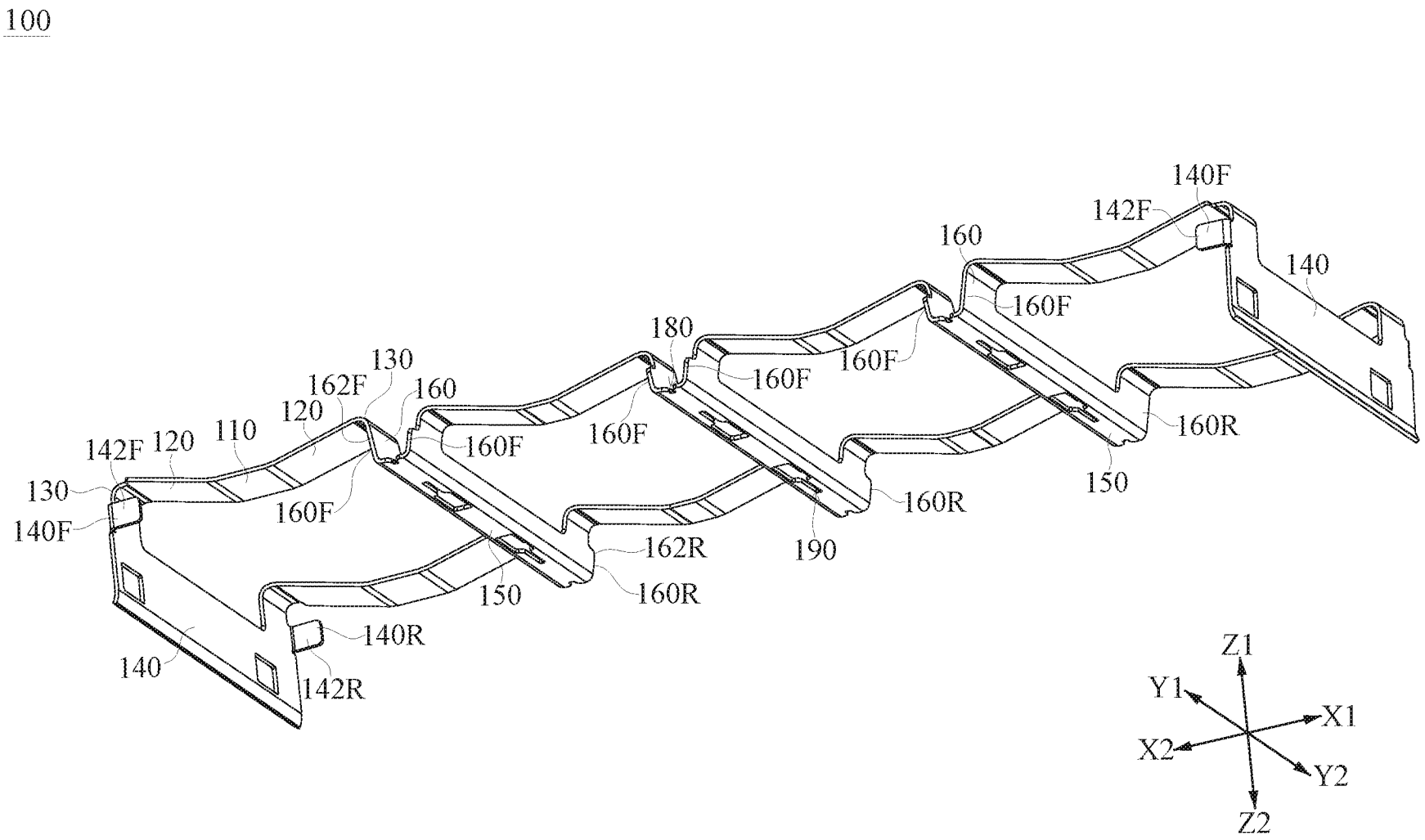
FIG. 5 is a perspective schematic view of a clip shown in FIG. 1.

FIG. 5 is a perspective schematic view of the clip 100 shown in FIG. 1. Referring to FIG. 5, the clip 100 includes a plurality of elastic pressing portions 110, elastic arm portions 120 each of which obliquely extends upwardly and are connect to the adjacent elastic pressing portion 110 and is provided to a side of the adjacent elastic pressing portion 110, a plurality of bending portions 130 which are respectively connected to the corresponding elastic arm portions 120 and bend downwardly, two outer side plates 140 which are respectively connected to two corresponding bending portions 130 positioned at the outermost sides, a plurality of inner side plates 160 which are respectively connected to the corresponding bending portions 130 positioned at an inner side, and a plurality of inner fixing portion 150 which are fixed to the top wall 10T of the shielding shell 10 and each connect two adjacent inner side plates 160, here based on the outer side plate 140, an inner side is a direction along which the outer side plate 140 faces the thermal conducting plate 40 in the left-right direction X2-X1, and an outer side is a direction along which the outer side plate 140 is away from the thermal conducting plate 40 in the left-right direction X2-X1, and here the inner side plate 160 is positioned between the corresponding elastic pressing portion 110 and the corresponding inner fixing portion 150.

Figure 6:
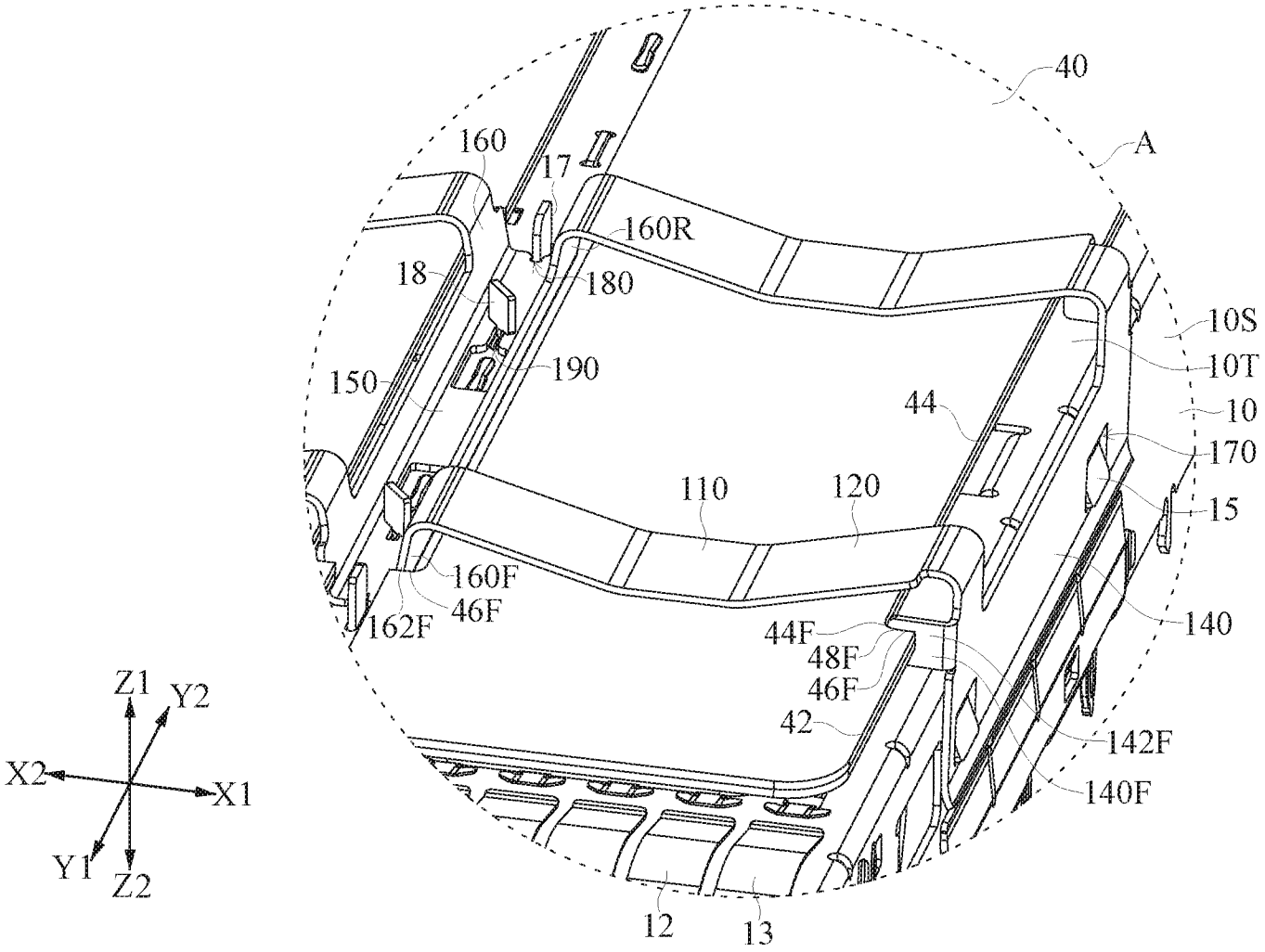
FIG. 6 is a partially enlarged perspective schematic view of a region of FIG. 1.

FIG. 6 is a partially enlarged perspective schematic view of a region A of FIG. 1. FIG. 6 illustrates cooperation of the clip 100 and the thermal conducting plate 40 positioned at the outermost side. Referring to FIG. 6, the elastic pressing portion 110 of the clip 100 presses against a top surface of the corresponding thermal conducting plate 40, and the top wall 10T of the shielding shell 10 supports a bottom surface of the corresponding thermal conducting plate 40. Therefore, the clip 100 and the shielding shell 10 cooperates with each other to limit relative displacement of the thermal conducting plate 40 relative to the shielding shell 10 in the up-down direction Z1-Z2. In addition, the two outer side plates 140 of the clip 100 are respectively mounted to the two side walls 10S of the shielding shell 10. The outer side plate 140 of the clip 100 and the inner side plates 160 of the clip 100 cooperate correspondingly to limit relative displacement of the thermal conducting plates 40 relative to the shielding shell 10 in the left-right direction X2-X1.

Moreover, each outer side plate 140 of the clip 100 includes a first rearward displace limiting portion 140F. The first rearward displace limiting portion 140F is configured to cooperate with the rearward stopped portion 46F of the thermal conducting plate 40 so as to limit relative displacement of the thermal conducting plate 40 relative to the shielding shell 10 toward the rear Y2. Displacement of the thermal conducting plate 40 toward the rear Y2 is limited. Specifically, the first rearward displace limiting portion 140F of each outer side plate 140 includes a front sheet 142F. The front sheet 142F extends to the rear of the rearward stopped portion 46F of the corresponding side edge 42 of the corresponding thermal conducting plate 40 so as to stop the inner edge 48F of the rearward stopped portion 46F of the corresponding side edge 42 of the corresponding thermal conducting plate 40. In the embodiment, the front sheet 142F of the clip 100 is a sheet whose sheet face is in vertical. However, the present disclosure is not limited thereto. In other embodiments, the front sheet 142F of the clip 100 may be a sheet whose sheet face horizontally lies (specifically shown in FIG. 11 and FIG. 12). Similarly, each inner side plate 160 of the clip 100 includes a second rearward displace limiting portion 160F. The second rearward displace limiting portion 160F is configured to cooperate with the rearward stopped portion 46F of the corresponding side edge 42 of the corresponding thermal conducting plate 40 so as to limit relative displacement of the corresponding thermal conducting plate 40 relative to the shielding shell 10 toward the rear Y2. Therefore, displacement of thermal conducting plate 40 toward the rear Y2 is limited. Specifically, the second rearward displace limiting portion 160F of each inner side plate 160 includes a front edge 162F. The front edge 162F extends to the rear of the rearward stopped portion 46F of the corresponding side edge 42 of the corresponding thermal conducting plate 40 to stop the rearward stopped portion 46F of the corresponding thermal conducting plate 40.

Figure 7:
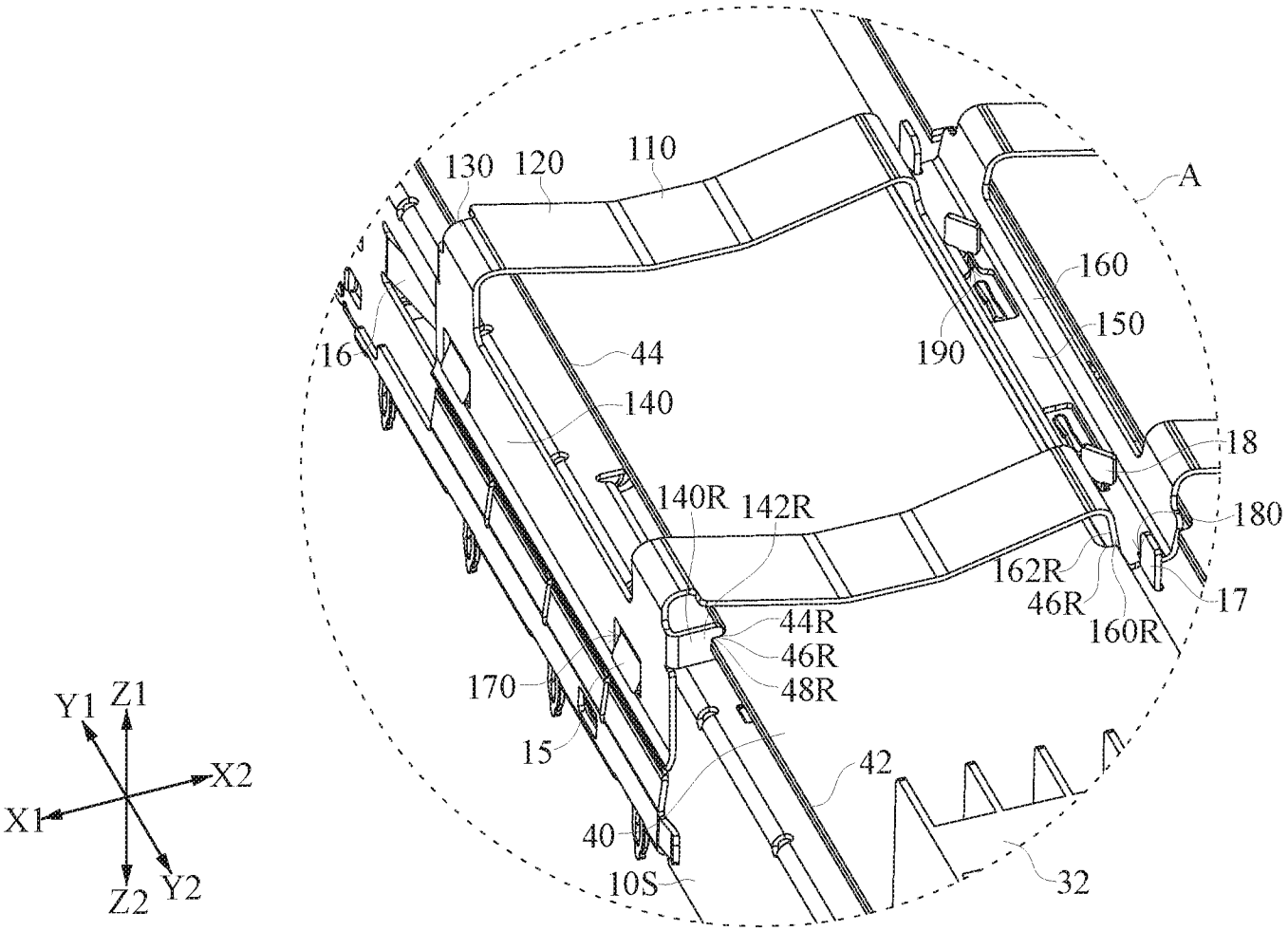
FIG. 7 is a partially enlarged perspective schematic view of the region of FIG. 6 from another angle.

FIG. 7 is a partially enlarged perspective schematic view of the region A of FIG. 6 from another angle. Referring to FIG. 7, each outer side plate 140 of the clip 100 further includes a first forward displace limiting portion 140R. The first forward displace limiting portion 140R is configured to cooperate with the forward stopped portion 46R of the corresponding side edge 42 of the corresponding thermal conducting plate 40 so as to limit relative displacement of the corresponding thermal conducting plate 40 relative to the shielding shell 10 toward the front Y1. Displacement of the thermal conducting plate 40 toward the front Y1 is limited. Specifically, the first forward displace limiting portion 140R of each outer side plate 140 includes a rear sheet 142R. The rear sheet 142R extends to the front of the forward stopped portion 46R of the corresponding side edge 42 of the corresponding thermal conducting plate 40 so as to stop the forward stopped portion 46R of the corresponding thermal conducting plate 40. In the embodiment, the rear sheet 142R of the clip 100 is sheet whose sheet face is in vertical. However, the present disclosure is not limited thereto. In other embodiments, the rear sheet 142R of the clip 100 may be a sheet whose sheet face horizontally lies (specifically shown in FIG. 11 and FIG. 12). Similarly, each inner side plate 160 of the clip 100 includes a second forward displace limiting portion 160R. The second forward displace limiting portion 160R is configured to cooperate with the forward stopped portion 46R of the corresponding side edge 42 of the corresponding thermal conducting plate 40 so as to limit the relative displacement of the corresponding thermal conducting plate 40 relative to the shielding shell 10 toward the front Y1. Therefore, displacement of the thermal conducting plate 40 toward the front Y1 is limited. Specifically, the second forward displace limiting portion 160R of each inner side plate 160 includes a rear edge 162R. The rear edge 162R extends to the front of the corresponding side edge 42 of the corresponding thermal conducting plate 40 of the forward stopped portion 46R so as to stop the forward stopped portion 46R of the corresponding thermal conducting plate 40.

In conclusion, with respect to the thermal conducting plate 40 positioned at the outermost side, the two side edges 42 of the thermal conducting plate 40 respectively cooperate with one outer side plate 140 and one inner side plate 160 of the clip 100 so as to limit relative displacement of the thermal conducting plate 40 relative to the shielding shell 10 in the front-rear direction Y1-Y2. With respect to the thermal conducting plate 40 positioned at the inner side, the two side edges 42 of the thermal conducting plate 40 respectively cooperate with the two inner side plates 160 of the clip 100 so as to limit relative displacement of the thermal conducting plate 40 relative to the shielding shell 10 in the front-rear direction Y1-Y2.

In some embodiments, the front sheet 142F of the clip 100 is a sheet whose sheet face is in vertical, and the rear sheet 142R of the clip 100 is a sheet whose sheet face horizontally lies. In some embodiments, the front sheet 142F of the clip 100 is a sheet whose sheet face horizontally lies, and the rear sheet 142R of the clip 100 is a sheet whose sheet face is in vertical.

Due to cooperation between each side edge 42 of the thermal conducting plate 40 and corresponding one of each outer side plate 140 and each inner side plate 160 of the clip 100, it can avoid the thermal conducting plate 40 unintentionally disengaging from the shielding shell 10 in the front-rear direction Y1-Y2.

Referring to FIG. 6, when the clip 100 is mounted to the shielding shell 10, a latching tab 15 of the side wall 10S of the shielding shell 10 passes through a latching hole 170 of the corresponding outer side plate 140 of the clip 100, a positioning piece 17 of the shielding shell 10 which extends out of the top wall 10T is positioned in a positioning opening 180 of the inner fixing portion 150 of the clip 100, a fixing piece 18 of the shielding shell 10 which extends out of the top wall 10T passes through a fixing hole 190 of the inner fixing portion 150 of the clip 100, and then a rotational force in a X2-X1-Y1-Y2 plane is applied to the fixing piece 18 of the shielding shell 10, so as to make the fixing piece 18 no longer parallel to the fixing hole 190 of the shielding shell 10, therefore the clip 100 is fixed to the shielding shell 10. In the embodiment, an upper end of the partitioning plate 14 of the shielding shell 10 passes through the top wall 10T of the shielding shell 10 to form the positioning piece 17 and the fixing piece 18.

Figure 8:
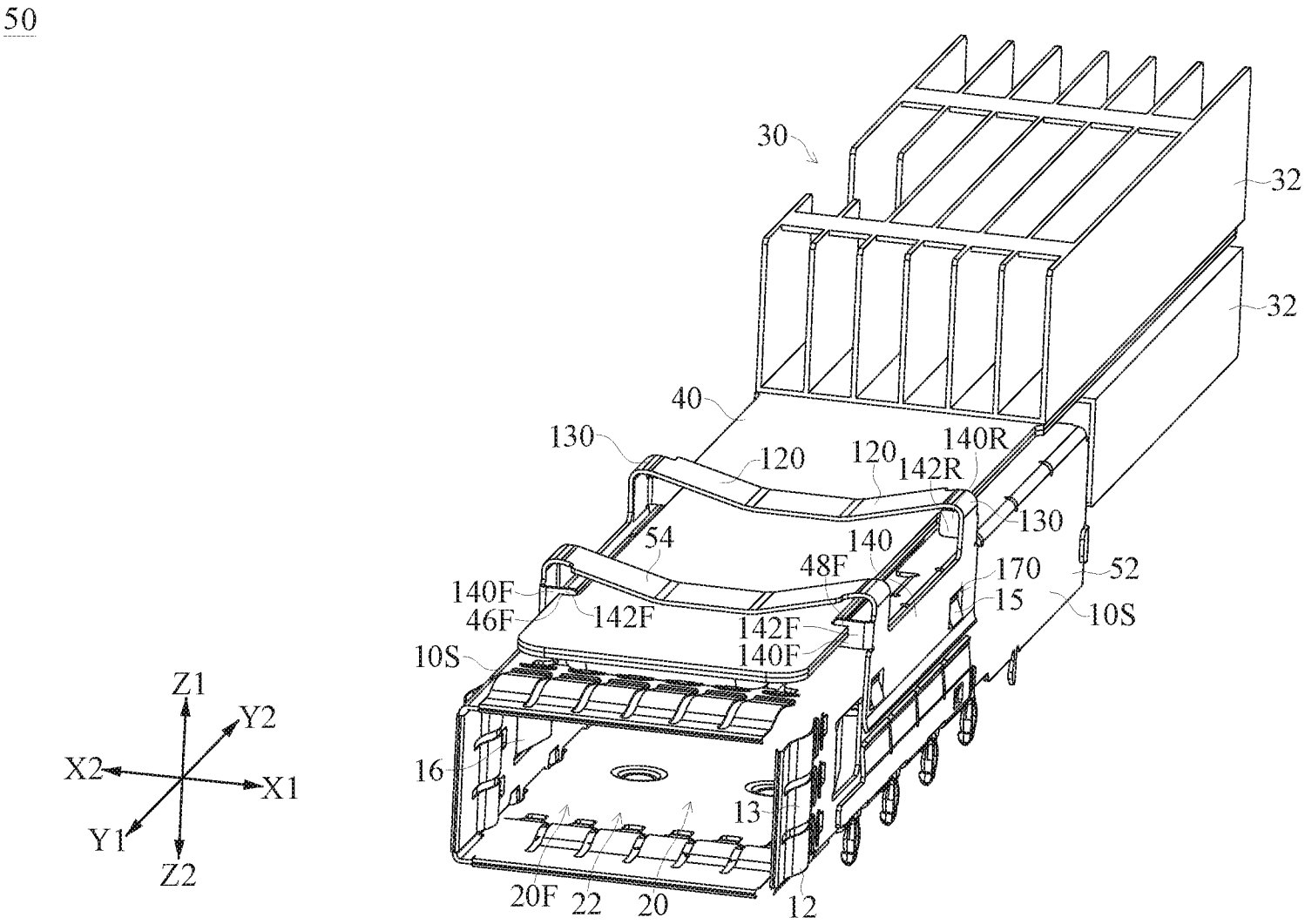
FIG. 8 is an assembled perspective schematic view of a second embodiment of a connector assembly.
Figure 9:
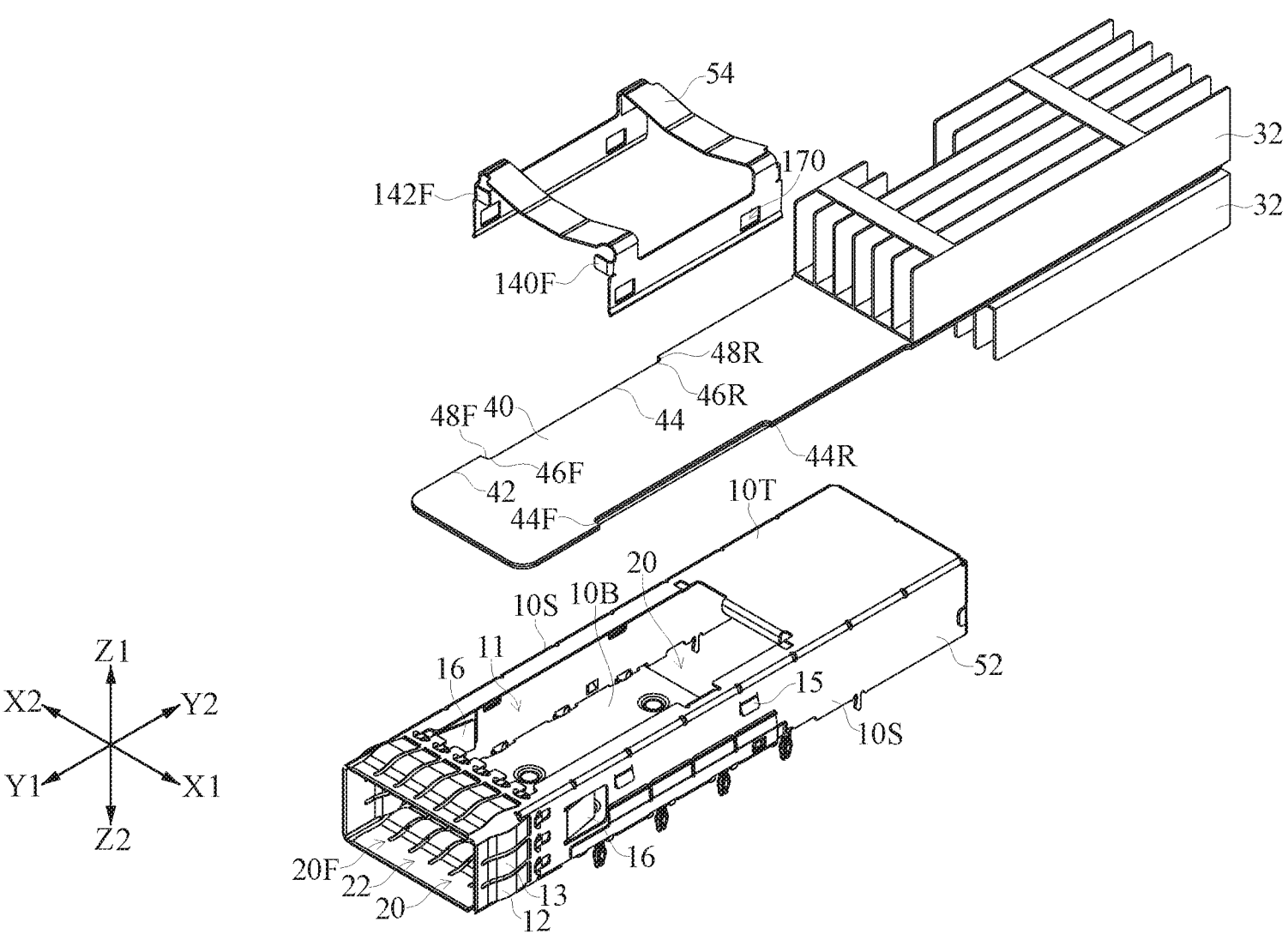
FIG. 9 is an exploded perspective schematic view of the connector assembly of FIG. 8.
Figure 10:
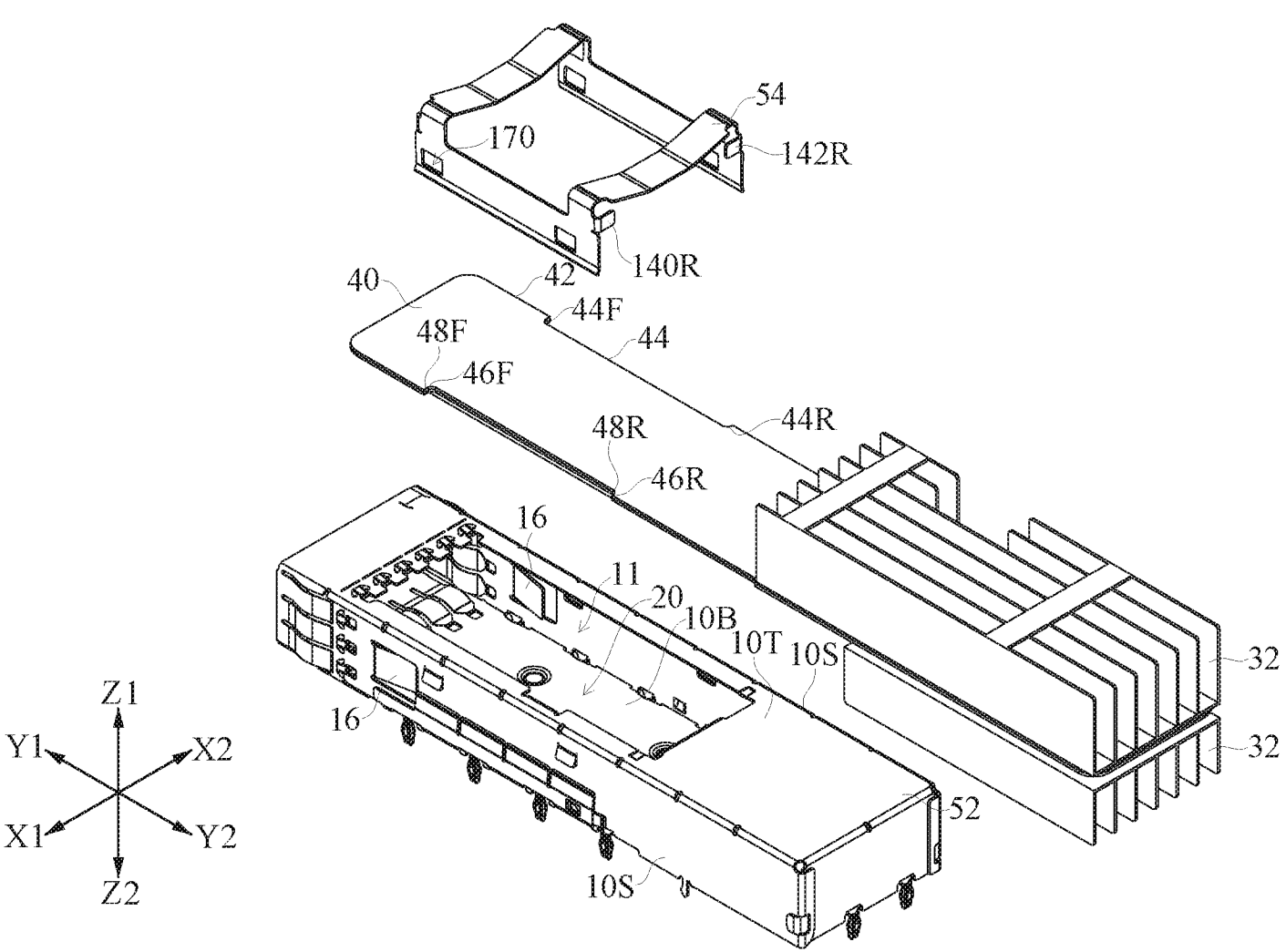
FIG. 10 is an exploded perspective schematic view of the connector assembly of FIG. 8 from another angle.

FIG. 8 is an assembled perspective schematic view of a second embodiment of a connector assembly 50. FIG. 9 is an exploded perspective schematic view of the connector assembly 50 of FIG. 8. FIG. 10 is an exploded perspective schematic view of the connector assembly 50 of FIG. 8 from another angle. Referring to FIG. 8 to FIG. 10, the connector assembly 50 is similar to the connector assembly 5 shown in FIG. 1, but differs in that, the connector assembly 50 includes a shielding shell 52, but a top wall 10T, a bottom wall 10B and two side walls 10S of the shielding shell 52 form a single receiving space 20; and the connector assembly 50 includes a clip 54, two bending portions 130 included by the clip 54 are connected to the two outer side plates 140 respectively. Therefore, a first rearward displace limiting portion 140F and a first forward displace limiting portion 140R of each outer side plate 140 of the clip 54 cooperate with a rearward stopped portion 46F and a forward stopped portion 46R of the same thermal conducting plate 40 so as to limit relative displacement of the thermal conducting plate 40 relative to the shielding shell 10 in the front-rear direction Y1-Y2. In addition, in the embodiment, a front sheet 142F and a rear sheet 142R of the clip 54 each are a sheet whose sheet face is in vertical.

Figure 11:
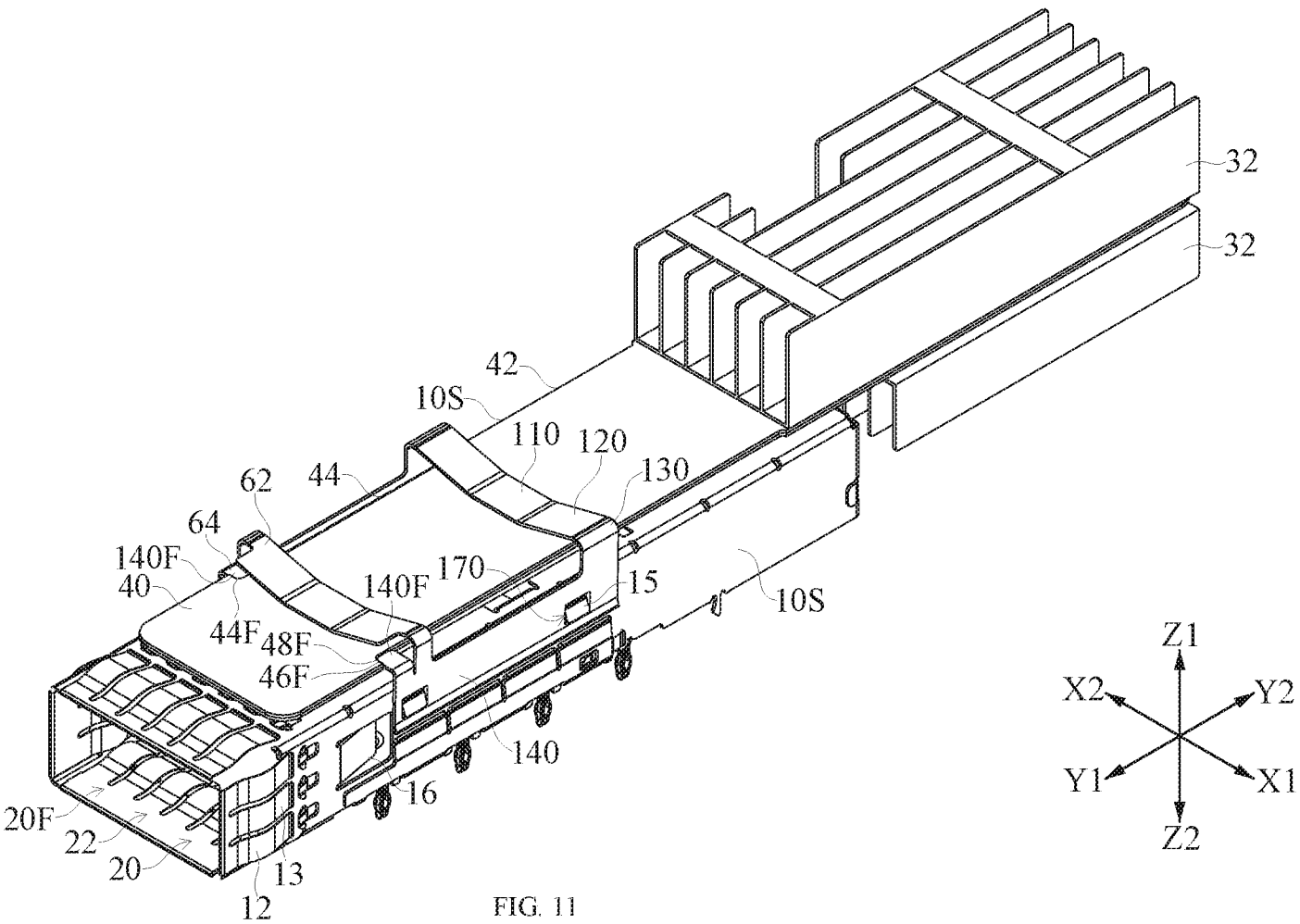
FIG. 11 is an assembled perspective schematic view of a third embodiment of a connector assembly.
Figure 12:
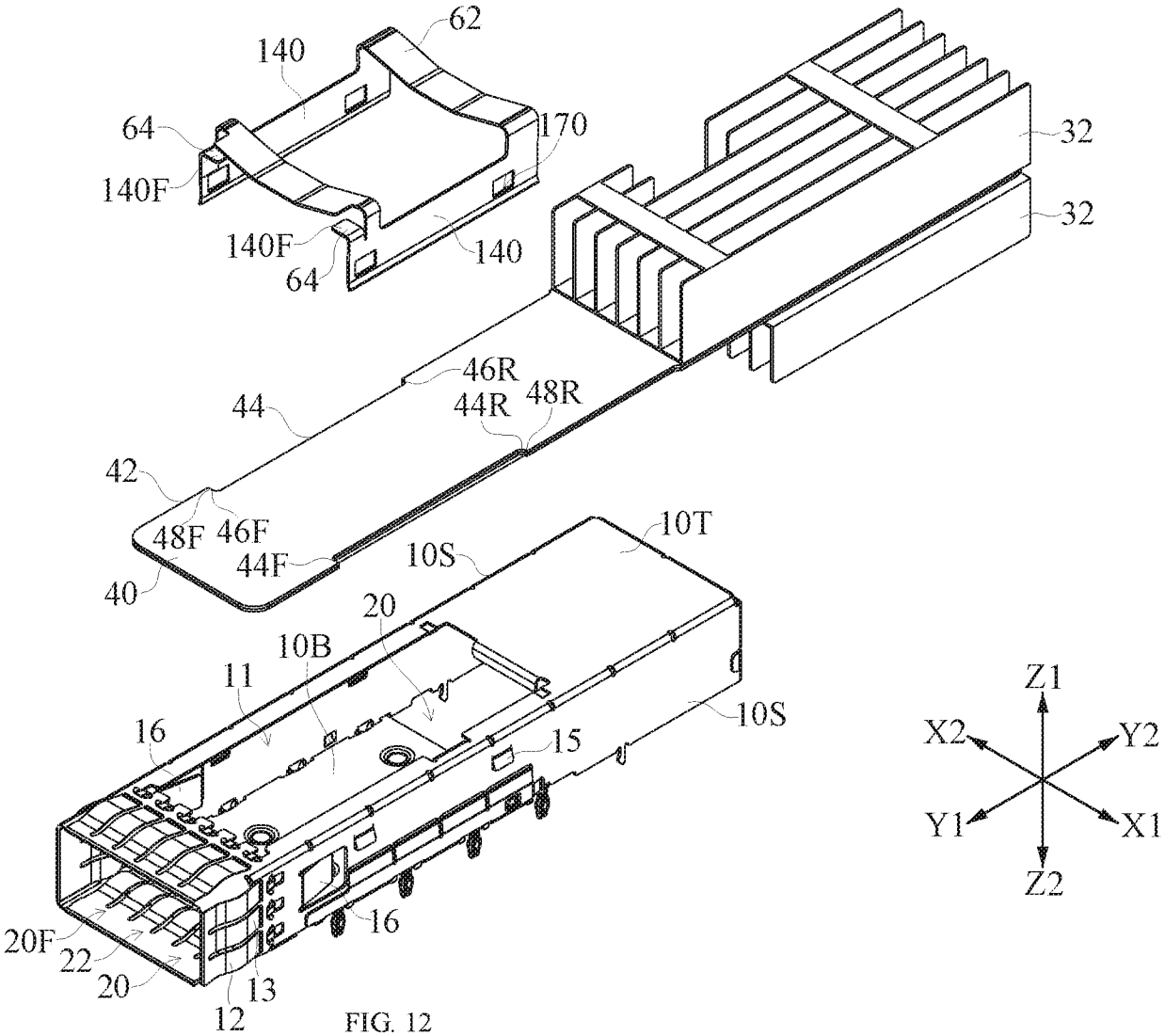
FIG. 12 is an exploded perspective schematic view of the connector assembly of FIG. 11.

FIG. 11 is an assembled perspective schematic view of a connector assembly 60 of a third embodiment. FIG. 12 is an exploded perspective schematic view of the connector assembly 60 of FIG. 11. Referring to FIG. 11 and FIG. 12, the connector assembly 60 is similar to the connector assembly 50 shown in FIG. 8, but differs in that, the connector assembly 60 includes a clip 62, and each outer side plate 140 of the clip 62 only includes a first rearward displace limiting portion 140F, and each first rearward displace limiting portion 140F includes a front sheet 64, the front sheet 64 is a sheet whose sheet face horizontally lies.

In the above description, the left-right direction X2-X1, the front-rear direction Y1-Y2, the up-down direction Z1-Z2, the up direction Z1, the down direction Z2, the front direction Y1, the rear direction Y2, the left direction X2 and the right direction X1 are used to illustrate relative positional relationship and action relationship of the components of FIG. 1 to FIG. 12. That is, those directions are not absolute directions but relative directions. Thus, those directions are not intended to limit orientation of components of FIG. 1 to FIG. 12 in use. The explanation on the directions described in the present disclosure should be changed depending on the change of the orientations of components of FIG. 1 to FIG. 12.

While the present disclosure and advantages thereof are described in detail, it is understood that various changes, replacements and substitutions may be made without departing from the spirit and scope of the present disclosure as defined by the appended claims. For example, many processes described above can be implemented in a variety of ways, and many processes described above can be replaced with other processes or combinations thereof. Further, the scope of the present disclosure is not limited to the specific embodiments of process, machinery, manufacturing, substance composition, means, method or step described in the specification. Those skilled in the art can understand from the disclosed contents of the present disclosure that existing or future developed process, machinery, manufacturing, substance composition, means, method or step which has the same function or achieve essentially the same result as the corresponding embodiment described herein can be used in accordance with the present disclosure. Accordingly, such a process, machinery, manufacturing, substance composition, mean, method or step is included in the claims of the present disclosure.

What is claimed is:

1. A connector assembly, comprising:

a shielding shell comprising a top wall, two side walls and a receiving space which extends along a front-rear direction, the receiving space comprising a front end toward the front, the front end comprising an insertion opening;

a heat dissipating module comprising a thermal conducting plate which corresponds to the receiving space and is provided to the top wall of the shielding shell, the thermal conducting plate comprising a front segment configured to receive a clip at side edges of the front segment, the side edges comprising rearward stopped portions toward the rear; and wherein the clip comprises an elastic pressing portion which presses against a top surface of the front segment of the thermal conducting plate and outer side plates which are assembled to the corresponding side walls of the shielding shell, the outer side plate comprising a rearward displace limiting portion which cooperates with the corresponding rearward stopped portion of the thermal conducting plate so as to limit relative displacement of the thermal conducting plate relative to the shielding shell toward the rear.

2. The connector assembly according to claim 1, wherein the side edge of the thermal conducting plate comprises a notch, the notch comprises a front end, the front end comprises the rearward stopped portion, the rearward stopped portion comprises an inner edge of the front end of the notch toward the rear, wherein the rearward displace limiting portion of the clip comprises a front sheet, the front sheet extends to the rear of the corresponding rearward stopped portion of the thermal conducting plate.

3. The connector assembly according to claim 1, wherein the side edge of the thermal conducting plate further comprises a forward stopped portion toward the front, and wherein the outer side plate of the clip further comprises a forward displace limiting portion, the forward displace limiting portion cooperates with the corresponding forward stopped portion of the thermal conducting plate so as to limit relative displacement of the thermal conducting plate relative to the shielding shell toward the front.

4. The connector assembly according to claim 3, wherein the side edge of the thermal conducting plate comprises a notch, the notch comprises a front end and a rear end, the front end comprises the rearward stopped portion, the rearward stopped portion comprises an inner edge of the front end of the notch toward the rear, the rear end comprises the forward stopped portion, the forward stopped portion comprises an inner edge of the rear end of the notch toward the front, wherein the rearward displace limiting portion of the clip comprises a front sheet, the front sheet extends to the rear of the corresponding rearward stopped portion of the thermal conducting plate, and wherein the forward displace limiting portion of the clip comprises a rear sheet, the rear sheet extends to the front of the corresponding forward stopped portion of the thermal conducting plate.

5. The connector assembly according to claim 4, wherein the front sheet is a sheet whose sheet face is in vertical or a sheet whose sheet face horizontally lies.

6. The connector assembly according to claim 4, wherein the front sheet and the rear sheet each are a sheet whose sheet face is in vertical or a sheet whose sheet face horizontally lies.

7. The connector assembly according to claim 1, wherein the top wall of the shielding shell comprises a window which passes through and communicates with the receiving space, wherein the heat dissipating module further comprises a contacting plate which is provided to a bottom surface of the thermal conducting plate, the contacting plate extends into the receiving space via the window.

8. The connector assembly according to claim 7, wherein the thermal conducting plate is a vapor chamber heatsink.

9. The connector assembly as in claim 1 wherein the thermal conducting plate is integral to the heat dissipating module.

10. A connector assembly, comprising:

a shielding shell comprising a top wall, two side walls and at least two receiving spaces which extend along a front-rear direction, each receiving space comprising a front end toward the front, the front end comprising an insertion opening;

at least two heat dissipating modules respectively corresponding to the at least two receiving spaces, each heat dissipating module comprising a thermal conducting plate which is provided to the top wall of the shielding shell, the thermal conducting plate comprising two side edges, the two side edges of the thermal conducting plate each comprising a rearward stopped portion toward the rear; and a clip comprising an inner fixing portion fixed to the top wall of the shielding shell, outer side plates which are assembled to the corresponding side walls of the shielding shell, elastic pressing portions which press against top surfaces of the corresponding thermal conducting plates, and inner side plates which each are provided between the elastic pressing portion and the inner fixing portion, wherein the outer side plate of the clip comprising a first rearward displace limiting portion, and the inner side plate of the clip comprising a second rearward displace limiting portion, wherein the first rearward displace limiting portion of the outer side plate of the clip and the rearward stopped portion of the corresponding side edge of the corresponding thermal conducting plate cooperate with each other and the second rearward displace limiting portion of the inner side plate of the clip and the rearward stopped portion of the corresponding side edge of the corresponding thermal conducting plate cooperate with each other, so as to limit relative displacement of the corresponding thermal conducting plate relative to the shielding shell toward the rear.

11. The connector assembly according to claim 10, wherein the two side edges of the thermal conducting plate each comprise a notch, the notch comprises a front end, the front end comprises the rearward stopped portion, the rearward stopped portion comprises an inner edge of the front end of the notch toward the rear, wherein the first rearward displace limiting portion of the outer side plate of the clip comprises a front sheet, the front sheet extends to the rear of the rearward stopped portion of the corresponding side edge of the corresponding thermal conducting plate, wherein the second rearward displace limiting portion of the inner side plate of the clip comprises a front edge, the front edge extends to the rear of the rearward stopped portion of the corresponding side edge of the corresponding thermal conducting plate.

12. The connector assembly according to claim 11, wherein the front sheet is a sheet whose sheet face is in vertical or a sheet whose sheet face horizontally lies.

13. The connector assembly according to claim 10, wherein the two side edges of the thermal conducting plate each further comprise a forward stopped portion toward the front, wherein the outer side plate of the clip comprises a first forward displace limiting portion, and the inner side plate of the clip comprises a second forward displace limiting portion, wherein the first forward displace limiting portion of the outer side plate of the clip and the forward stopped portion of the corresponding side edge of the corresponding thermal conducting plate cooperate with each other and the second forward displace limiting portion of the inner side plate of the clip and the forward stopped portion of the corresponding side edge of the corresponding thermal conducting plate cooperate with each other, so as to limit relative displacement of the corresponding thermal conducting plate relative to the shielding shell toward the front.

14. The connector assembly according to claim 13, wherein the two side edges of the thermal conducting plate each comprise a notch, the notch comprises a front end and a rear end, the front end comprises the rearward stopped portion, the rearward stopped portion comprises an inner edge of the front end of the notch toward the rear, wherein the first rearward displace limiting portion of the outer side plate of the clip comprises a front sheet, the front sheet extends to the rear of the rearward stopped portion of the corresponding side edge of the corresponding thermal conducting plate, wherein the first forward displace limiting portion of the outer side plate of the clip comprises a rear sheet, the rear sheet extends to the front of the forward stopped portion of the corresponding side edge of the corresponding thermal conducting plate, wherein the second rearward displace limiting portion of the inner side plate of the clip comprises a front edge, the front edge extends to the rear of the rearward stopped portion of the corresponding side edge of the corresponding thermal conducting plate, and wherein the second forward displace limiting portion of the inner side plate of the clip comprises a rear edge, the rear edge extends to the front of the forward stopped portion of the corresponding side edge of the corresponding thermal conducting plate.

15. The connector assembly according to claim 14, wherein the front sheet and the rear sheet each are a sheet whose sheet face is in vertical or a sheet whose sheet face horizontally lies.

16. The connector assembly according to claim 10, wherein the top wall of the shielding shell comprises windows which each pass through and communicate with the corresponding receiving space, wherein each heat dissipating module further comprises a contacting plate which is provided to a bottom surface of the thermal conducting plate, each contacting plate extends into the corresponding receiving space via the corresponding window.

17. The connector assembly according to claim 16, wherein the thermal conducting plate is a vapor chamber heatsink.

18. A connector assembly, comprising:

a shielding shell comprising a top wall, side walls and at least one receiving space which extends along a front-rear direction, the receiving space comprising a front end toward the front, the front end comprising an insertion opening;

at least one heat dissipating module comprising a thermal conducting plate which corresponds to the receiving space and is provided to the top wall, the thermal conducting plate comprising a front segment configured to receive a clip at side edges of the front segment of the thermal conducting plate, the side edges comprising stopped portions; and wherein the clip comprises an elastic pressing portion which presses against a top surface of the front segment of the thermal conducting plate and side plates, the side plate of the clip comprising a limiting portion, the limiting portion is configured to cooperate with the corresponding stopped portion of the thermal conducting plate so as to limit relative displacement of the thermal conducting plate relative to the shielding shell toward the front or toward the rear.

19. The connector assembly as in claim 18 wherein the thermal conducting plate is integral to the at least one heat dissipating module.

* * * * *